US009655170B2

(12) United States Patent
Ikai et al.

(10) Patent No.: US 9,655,170 B2
(45) Date of Patent: May 16, 2017

(54) CERAMIC HEATER, GLOW PLUG, METHOD OF MANUFACTURING CERAMIC HEATER AND METHOD OF MANUFACTURING GLOW PLUG

(71) Applicant: NGK Spark Plug Co., Ltd., Nagoya-shi, Aichi (JP)

(72) Inventors: Yoshihito Ikai, Aichi-ken (JP); Ryo Suzuki, Aichi-ken (JP); Yutaka Sekiguchi, Aichi-ken (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 379 days.

(21) Appl. No.: 14/325,846

(22) Filed: Jul. 8, 2014

(65) Prior Publication Data

US 2015/0014302 A1 Jan. 15, 2015

(30) Foreign Application Priority Data

Jul. 9, 2013 (JP) ..... 2013-143421

(51) Int. Cl.

| | |
|---|---|
| ***B23B 11/00*** | (2006.01) |
| ***F23Q 7/00*** | (2006.01) |
| ***H05B 3/18*** | (2006.01) |
| ***H05B 3/48*** | (2006.01) |
| ***B28B 11/00*** | (2006.01) |

(52) U.S. Cl.

CPC ..... *H05B 3/48* (2013.01); *B28B 11/00* (2013.01); *F23Q 7/001* (2013.01); *F23Q 2007/004* (2013.01); *H05B 2203/027* (2013.01); *Y10T 29/49083* (2015.01)

(58) Field of Classification Search

USPC ..... 219/270

See application file for complete search history.

(56) References Cited

U.S. PATENT DOCUMENTS

| | | | | |
|---|---|---|---|---|
| 8,530,802 | B2 * | 9/2013 | Yamamoto | H05B 3/141 123/145 R |
| 9,288,845 | B2 * | 3/2016 | Yamamoto | F23Q 7/001 |
| 2002/0036192 | A1 | 3/2002 | Sato et al. | 219/270 |
| 2002/0162830 | A1 | 11/2002 | Taniguchi et al. | 219/270 |
| 2003/0029856 | A1 | 2/2003 | Tatematsu et al. | 219/270 |
| 2008/0210684 | A1 | 9/2008 | Kukino et al. | 219/542 |
| 2010/0155389 | A1 | 6/2010 | Yamamoto | 219/548 |
| 2011/0233190 | A1 | 9/2011 | Kukino et al. | 219/542 |

(Continued)

FOREIGN PATENT DOCUMENTS

| | | | |
|---|---|---|---|
| JP | H10-110951 A | 4/1998 | F23Q 7/00 |
| JP | 2002-334768 A | 11/2002 | H05B 3/02 |

(Continued)

OTHER PUBLICATIONS

Search Report issued in corresponding European Patent Application No. 14175938.1-1602, dated Dec. 23, 2014.

*Primary Examiner* — Joseph M Pelham
(74) *Attorney, Agent, or Firm* — Kusner & Jaffe

(57) ABSTRACT

A ceramic heater wherein in at least one cross section of the ceramic heater orthogonal to the axial direction, a first resistor cross section has no protrusion on a first inner portion of the contour of a first resistor cross section, and has two or more protrusions on a first outer portion of the contour of the first resistor cross section and a method of manufacturing the ceramic heater.

3 Claims, 6 Drawing Sheets

(56) References Cited

U.S. PATENT DOCUMENTS

| | | | | |
|---|---|---|---|---|
| 2011/0253704 | A1 | 10/2011 | Yamamoto | 219/544 |
| 2012/0234823 | A1 | 9/2012 | Yamamoto | 219/520 |

FOREIGN PATENT DOCUMENTS

| | | | | |
|---|---|---|---|---|
| JP | 2003-40678 | A | 2/2003 | C04B 35/584 |
| JP | 2005-340034 | A | 12/2005 | H05B 3/10 |
| JP | 2007-265893 | A | 10/2007 | H05B 3/48 |
| WO | WO 2008/123296 | A1 | 10/2008 | H05B 3/48 |
| WO | WO 2011065366 | A1 | 1/2011 | F23Q 7/00 |
| WO | WO 2011/052624 | A1 | 5/2011 | H05B 3/48 |

* cited by examiner

CERAMIC HEATER, GLOW PLUG, METHOD OF MANUFACTURING CERAMIC HEATER AND METHOD OF MANUFACTURING GLOW PLUG

FIELD OF THE INVENTION

The present invention relates to a ceramic heater used for a glow plug or the like.

BACKGROUND OF THE INVENTION

Conventionally, a ceramic heater has been utilized for various apparatuses, such as a glow plug. For manufacture of such a ceramic heater, there has been utilized a method of molding a heating element and a ceramic base member through use of molding dies.

PRIOR ART DOCUMENT

Patent Document 1: JP 2002-334768 A
Patent Document 2: WO2011/052624 A1
Patent Document 3: WO2008/123296 A1
Patent Document 4: JP 10-110951 A
Patent Document 5: JP 2005-340034 A
Patent Document 6: JP 2007-265893 A
Patent Document 7: JP 2003-40678 A However, in the case where molding is performed through use of molding dies, protrusions (also called burrs) may be formed as a result of the molding process. When such protrusions are formed, cracks may be generated around the protrusions. For example, a heating resistor having a generally U-like shape may be molded through use of two molding dies. Each of the two molding dies has a generally U-shaped recess corresponding to a generally U-shaped half of the heating resistor. When the two molding dies are combined, there is formed a cavity corresponding to the entirety of the generally U-like shape of the heating resistor. In the case where a heating resister is molded through use of such molding dies, since a line of joint (joint line) between the two molding dies appears on the wall surface of the generally U-shaped cavity on the inner circumferential side of the U-like shape, protrusions may be formed on an inner circumferential portion of the generally U-shaped heating resister. Upon energization, the temperature of the inner circumferential portion of the generally U-shaped heating resister is likely to become high. Accordingly, due to a difference in temperature between periods in which the ceramic heater is energized and periods in which the ceramic heater is not energized, cracks may be generated around the protrusions.

The main advantage of the present invention is that cracking of a ceramic heater is suppressed.

The present invention has been accomplished so as to solve, at least partially, the above-described problem, and the present invention can be embodied in the following application examples.

SUMMARY OF THE INVENTION

Application Example 1

In accordance with a first aspect of the present invention, there is provided a ceramic heater comprising:

a resistor which generates heat when energized; and a base member which extends along an axial direction, which is formed through use of ceramic, in which the resistor is embedded, and which is lower in electrical conductivity than the resistor, wherein the resistor includes a first portion extending from a forward end portion of the base member toward a rear end portion thereof, a second portion spaced from the first portion and extending from the forward end portion of the base member toward the rear end portion thereof, and a connection portion embedded in the forward end portion of the base member and connecting the first portion and the second portion; and in at least one of cross sections of the ceramic heater orthogonal to the axial direction, each of the cross sections containing, as a cross section of the resistor, a first resistor cross section and a second resistor cross section spaced from each other, with two straight lines which are in contact with both of a contour of the first resistor cross section and a contour of the second resistor cross section and which pass between the first resistor cross section and the second resistor cross section in the cross section of the ceramic heater being defined as a first straight line and a second straight line, the first resistor cross section has no protrusion on a first inner portion which is a portion of the contour of the first resistor cross section located on the side toward the second resistor cross section, the first inner portion extending from a first position at which the contour is in contact with the first straight line to a second position at which the contour is in contact with the second straight line, and the first resistor cross section has two or more protrusions on a first outer portion which is a portion of the contour of the first resistor cross section located on the side opposite the second resistor cross section, the first outer portion extending from the first position to the second position.

According to this configuration, the first resistor cross section has no protrusion on the first inner portion of the resistor where temperature is likely to become high when the ceramic heater is energized. Therefore, it is possible to decrease the possibility that cracks are produced in the ceramic heater due to a change in temperature. Since the first resistor cross section has two or more protrusions on the first outer portion, the close adhesion between the resistor and the base member can be enhanced.

Application Example 2

In accordance with a second aspect of the present invention, there is provided a ceramic heater according to application example 1, wherein the second resistor cross section has no protrusion on a second inner portion which is a portion of the contour of the second resistor cross section located on the side toward the first resistor cross section, the second inner portion extending from a third position at which the contour is in contact with the first straight line to a fourth position at which the contour is in contact with the second straight line, and the second resistor cross section has two or more protrusions on a second outer portion which is a portion of the contour of the second resistor cross section located on the side opposite the first resistor cross section, the second outer portion extending from the third position to the fourth position.

According to this configuration, the second resistor cross section has no protrusion on the second inner portion of the resistor where temperature is likely to become high when the ceramic heater is energized. Therefore, it is possible to decrease the possibility that cracks are produced in the ceramic heater due to a change in temperature. Since the second resistor cross section has two or more protrusions on the second outer portion, the close adhesion between the resistor and the base member can be enhanced.

Application Example 3

In accordance with a third aspect of the present invention, there is provided a ceramic heater according to application example 1 or 2, wherein, in the cross section of the ceramic heater, when the first outer portion is divided into two equi-length portions having the same length, the first resistor cross section has at least one protrusion on each of the equi-length portions.

According to this configuration, the protrusions are disposed in a dispersed manner as compared with the case where a protrusion is provided only on one equi-length portion and no protrusion is provided on the other equi-length portion. Therefore, the close adhesion between the resistor and the base member can be enhanced further.

Application Example 4

In accordance with a fourth aspect of the present invention, there is provided a glow plug comprising:

a tubular metallic shell; and a ceramic heater of any of the application examples 1 to 3, at least a portion of the ceramic heater being disposed inside the metallic shell.

Application Example 5

In accordance with a fifth aspect of the present invention, there is provided a method of manufacturing a ceramic heater comprising a resistor which generates heat when energized, and a base member which extends along an axial direction, which is formed through use of ceramic, in which the resistor is embedded, and which is lower in electrical conductivity than the resistor, wherein the resistor includes a first portion extending from a forward end portion of the base member toward a rear end portion thereof, a second portion spaced from the first portion and extending from the forward end portion of the base member toward the rear end portion thereof, and a connection portion embedded in the forward end portion of the base member and connecting the first portion and the second portion;

in at least one of cross sections of the ceramic heater orthogonal to the axial direction, each of the cross sections containing, as a cross section of the resistor, a first resistor cross section and a second resistor cross section spaced from each other, with two straight lines which are in contact with both of a contour of the first resistor cross section and a contour of the second resistor cross section and which pass between the first resistor cross section and the second resistor cross section in the cross section of the ceramic heater being defined as a first straight line and a second straight line, a first green body includes first and second parts of a portion corresponding to the base member, the first part being to come into contact with a first inner portion which is a portion of the contour of the first resistor cross section located on the side toward the second resistor cross section, the first inner portion extending from a first position at which the contour is in contact with the first straight line to a second position at which the contour is in contact with the second straight line, and the second part being to come into contact with a second inner portion which is a portion of the contour of the second resistor cross section located on the side toward the first resistor cross section, the second inner portion extending from a third position at which the contour is in contact with the first straight line to a fourth position at which the contour is in contact with the second straight line; and the method comprises a first step of molding the first green body, a second step of molding, on the first green body, a resistor portion corresponding to the first portion, the second portion, and the connection portion to thereby mold a second green body including the first green body and the resistor portion, and a third step of molding, on the second green body, a remaining part of the portion corresponding to the base member which remains after exclusion of the first green body, to thereby mold a third green body including the second green body and the remaining part.

This configuration prevents formation of protrusions on the first inner portion of the resistor where temperature is likely to become high upon energization, and prevents formation of protrusions on the second inner portion of the resistor where temperature is likely to become high upon energization. Therefore, it is possible to decrease the possibility that cracks are produced in the ceramic heater due to a change in temperature.

Application Example 6

In accordance with a sixth aspect of the present invention, there is provided a manufacturing method according to the application example 5, wherein the first green body includes portions which form portions of the outer surface of the base member.

According to this configuration, the accuracy of the positioning of the resistor in relation to the outer surface of the base member can be improved. Therefore, it is possible to decrease the possibility that cracks are produced due to positioning deviation. Also, variation of heating performance can be suppressed.

Application Example 7

In accordance with a seventh aspect of the present invention, there is provided a method of manufacturing a glow plug comprising a step of fixing the ceramic heater manufactured by the manufacturing method according to the application example 5 or 6 to a tubular metallic shell such that at least a portion of the ceramic heater is disposed inside the metallic shell.

Notably, the present invention can be realized in various forms. The present invention can be realized, for example, as a ceramic heater, a method of manufacturing a ceramic heater, a ceramic heater manufactured by the manufacturing method, a glow plug including a ceramic heater, a method of manufacturing a glow plug, a glow plug manufactured by the manufacturing method, or the like.

DETAILED DESCRIPTION OF PREFERRED EMBODIMENT

A. Embodiment

Figure 1A:
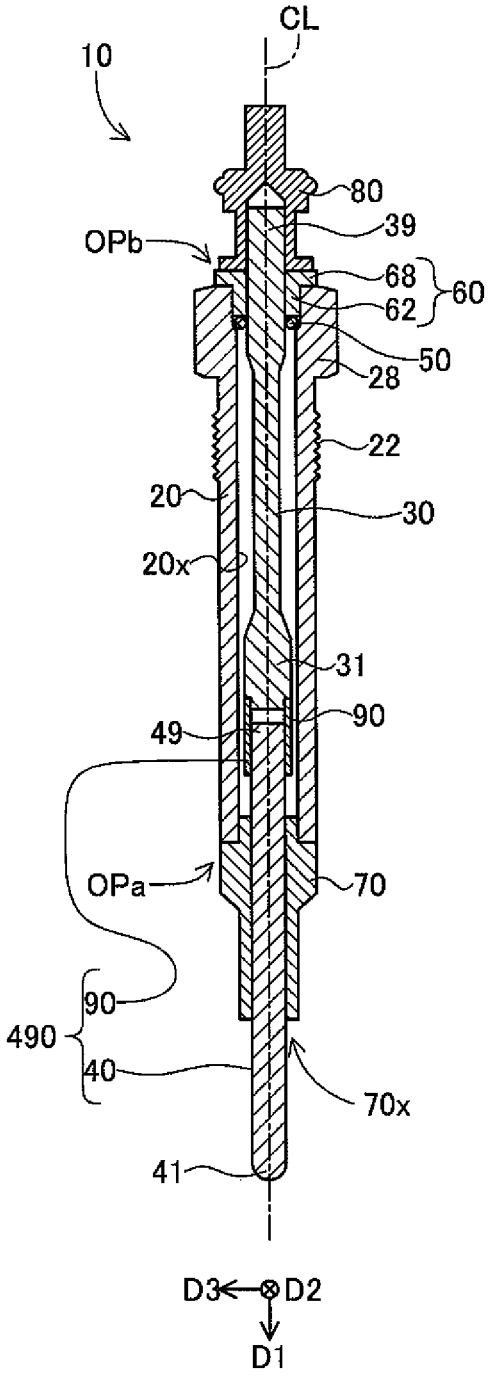
FIGS. 1(A) and 1(B) are explanatory views showing a glow plug which is one embodiment of the present invention.
Figure 1B:
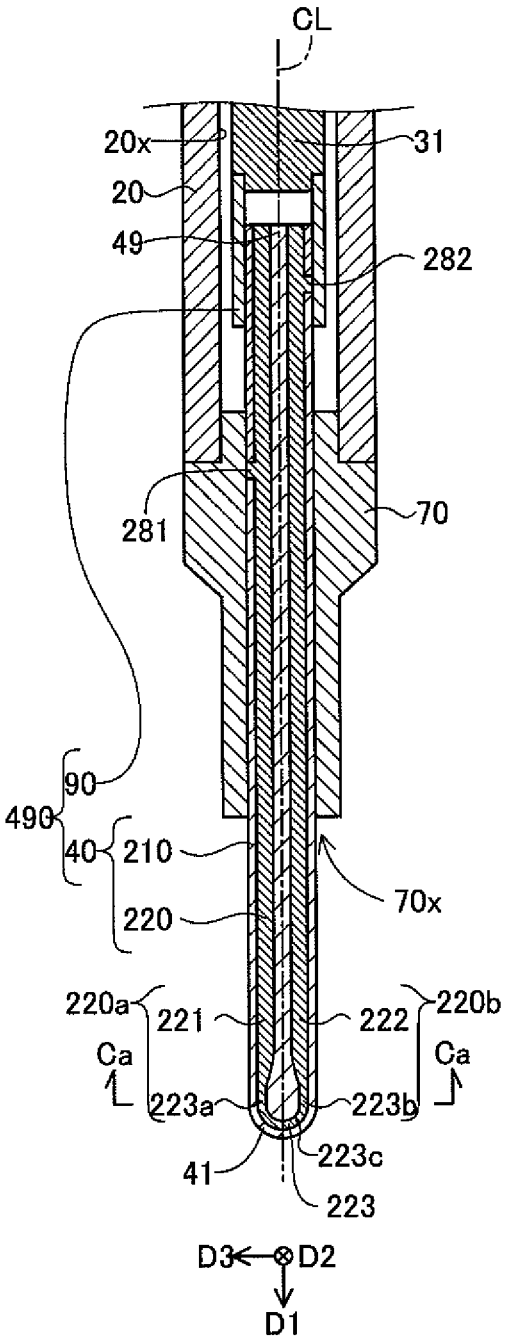

A1. Structure of Glow Plug:

A mode of the present invention will be described on the basis of an embodiment. FIGS. 1(A) and 1(B) are explanatory views showing a glow plug according to one embodiment of the present invention. The glow plug 10 functions as a heat source for, for example, assisting startup of an unillustrated internal combustion engine (e.g., a diesel engine). FIG. 1(A) is a longitudinal sectional view of the glow plug 10, and FIG. 1(B) is an enlarged sectional view showing a portion of the glow plug 10 (a portion including a ceramic heater 40). A line CL shown in these drawing shows a center axis of the glow plug 10. In the following description, the center axis CL is also referred to as the "axial line CL," and a direction parallel to the center axis CL is also referred to as the "axial direction." A first direction D1 in the drawings is a direction parallel to the axial line CL. As will be described later, the ceramic heater 40, which generates heat upon energization, forms an end portion of the glow plug 10 on the first direction D1 side. In the following description, the first direction D1 side is referred to as the "forward end side of the glow plug 10 (or simply the "forward end side")," and the side opposite the first direction D1 side is referred to as the "rear end side of the glow plug 10 (or simply the "rear end side")." A second direction D2 and a third direction D3 in the drawings are directions which are orthogonal to each other and are orthogonal to the first direction D1. In the following description, the first direction D1 is simply referred to as the "+D1 direction," and the direction opposite the first direction D1 is simply referred to as the "−D1 direction." As to the remaining directions, each direction is specified by using a symbol "+" or a symbol "−." Also, the +D1 direction side is simply referred to as the "+D1 side," and the −D1 direction side is simply referred to as the "−D1 side." This rule applies to the sides associated with the remaining directions.

The glow plug 10 includes a metallic shell 20, a center rod 30, a ceramic heater 40, an O-ring 50, an insulating member 60, a metal sleeve 70 (hereinafter simply referred to as the "sleeve 70"), a terminal member 80, and a connection member 90. The metallic shell 20 is a tubular member having a through hole 20*x* extending along the center axis CL. The metallic shell 20 has a tool engagement portion 28 formed on an end portion thereof on the −D1 side, and a male screw portion 22 provided on the +D1 side of the tool engagement portion 28. The tool engagement portion 28 is a portion with which an unillustrated tool is engaged when the glow plug 10 is attached or detached. The male screw portion 22 includes a screw thread for screw engagement with a female screw of a mounting hole of an unillustrated internal combustion engine. The metallic shell 20 is formed of an electrically conductive material (e.g., metal such as carbon steel).

The center rod 30 is accommodated in the through hole 20*x* of the metallic shell 20. The center rod 30 is a member having the shape of a round bar. A forward end portion 31 (an end portion on the +D1 side) of the center rod 30 is located in the through hole 20*x*. A rear end portion 39 (an end portion on the −D1 side) of the center rod 30 projects toward the −D1 direction from an opening OPb of the metallic shell 20 on the −D1 side. The center rod 30 is formed of an electrically conductive material (e.g., stainless steel).

In the vicinity of the opening OPb, the O-ring 50 is provided between the outer surface of the center rod 30 and the wall surface of the through hole 20*x* of the metallic shell 20. The O-ring 50 is formed of elastic material (e.g., rubber). A ring-shaped insulating member 60 is attached to the opening OPb of the metallic shell 20. The insulating member 60 includes a tubular portion 62 and a flange portion 68 provided on the −D1 side of the tubular portion 62. The tubular portion 62 is sandwiched between the outer surface of the center rod 30 and the inner surface of a portion of the metallic shell 20 which forms the opening OPb. The insulating member 60 is formed of, for example, resin. The metallic shell 20 supports the center rod 30 through these members 50 and 60.

The terminal member 80 is disposed on the rear end side of the metallic shell 20 (specifically, on the −D1 side of the insulating member 60). The terminal member 80 is a cap-shaped member, and is formed of an electrically conductive material (e.g., metal such as nickel). The flange portion 68 of the insulating member 60 is sandwiched between the terminal member 80 and the metallic shell 20. The rear end portion 39 of the center rod 30 is inserted into the terminal member 80. As a result of the terminal member 80 being crimped, the terminal member 80 is fixed to the rear end portion 39. Thus, the terminal member 80 is electrically connected to the rear end portion 39.

The sleeve 70 is press-fitted into an end portion of the metallic shell 20 on the +D1 side (specifically, the opening OPa on the +D1 side). The sleeve 70 is a tubular member having a through hole 70*x* extending along the center axis CL. The sleeve 70 is formed of an electrically conductive material (e.g., stainless steel).

The ceramic heater 40, which generates heat upon energization, is press-fitted into the through hole 70*x* of the sleeve 70. The ceramic heater 40 is a rod-shaped member disposed to extend along the center axis CL. The outer circumferential surface of the ceramic heater 40 is held by the sleeve 70. A forward end portion 41 (an end portion on the +D1 side) of the ceramic heater 40 projects from the +D1 side end of the sleeve 70 toward the +D1 side, and a rear end portion 49 (an end portion on the −D1 side) of the ceramic heater 40 projects from the −D1 side end of the sleeve 70 toward the −D1 side. The rear end portion 49 of the ceramic heater 40 is inserted into the through hole 20*x* of the metallic shell 20.

The connection member 90 is fixed to the rear end portion 49 of the ceramic heater 40. The connection member 90 is a cylindrical tubular member having a through hole extending along the center axis CL, and is formed of an electrically conductive material (e.g., stainless steel). The rear end portion 49 of the ceramic heater 40 is press-fitted into a portion of the connection member 90 on the +D1 side. The forward end portion 31 (the end portion on the +D1 side) of the center rod 30 is press-fitted into a portion of the connection member 90 on the −D1 side. Thus, the forward end portion 31 is electrically connected to the connection member 90. In the following description, the combination of the ceramic heater 40 and the connection member 90 is also referred to as a "heater module 490."

Next, the details of the heater module 490 will be described. FIG. 1(B) shows a more specific sectional view of the connection member 90 and the ceramic heater 40. The ceramic heater 40 includes a round-rod-shaped base member 210 extending along the axial line CL, and a generally U-shaped resistor 220 embedded in the base member 210.

The base member 210 is formed of an insulating ceramic material (in the present embodiment, silicon nitride). A forward end portion of the base member 210 (namely, the forward end portion 41 of the ceramic heater 40) becomes gradually thin toward the forward end side. The resistor 220 is formed of an electrically conductive ceramic material. In the present embodiment, the resistor 220 is formed of a ceramic material which is obtained by mixing tungsten carbide (electrically conductive material) into silicon nitride, which is the same as the material of the base member 210. The electrical conductivity of the base member 210 is lower than that of the resistor 220.

The resistor 220 includes two lead portions 221 and 222, a heat generation portion 223 connected to the lead portions 221 and 222, and electrode connection portions 281 and 282. Each of the lead portions 221 and 222 extends, parallel to the axial line CL, from the rear end portion 49 of the ceramic heater 40 to a position near the forward end portion 41. The first lead portion 221 and the second lead portion 222 are disposed at positions which are approximately symmetric with respect to the center axis CL. The direction from the second lead portion 222 toward the first lead portion 221 is the third direction D3.

The heat generation portion 223 is embedded in the forward end portion 41 of the ceramic heater 40, and connects together the +D1 side end of the first lead portion 221 and the +D1 side end of the second lead portion 222. The shape of the heat generation portion 223 is a generally U-like shape; i.e., the heat generation portion 223 curves to follow the round shape of the forward end portion 41 of the ceramic heater 40. Specifically, the heat generation portion 223 includes a first straight portion 223*a* extending in the +D1 direction from the +D1 side end of the first lead portion 221, a second straight portion 223*b* extending in the +D1 direction from the +D1 side end of the second lead portion 222, and a curved connection portion 223*c* connecting together the +D1 side end of the first straight portion 223*a* and the +D1 side end of the second straight portion 223*b*. The cross-sectional area of the heat generation portion 223 is smaller than those of the lead portions 221 and 222. Accordingly, the electrical resistance of the heat generation portion 223 per unit length is larger than those of the lead portions 221 and 222. As a result, when the ceramic heater is energized, the temperature of the heat generation portion 223 increases quickly as compared with other portions.

The first electrode connection portion 281 is connected to a portion of the first lead portion 221 on the −D1 side. The first electrode connection portion 281 is a member extending along the radial direction. An inner end portion of the first electrode connection portion 281 is connected to the first lead portion 221, and an outer end portion thereof is exposed on the outer surface of the ceramic heater 40. The exposed portion of the first electrode connection portion 281 is in contact with the inner circumferential surface of the sleeve 70. Thus, the sleeve 70 and the first lead portion 221 are electrically connected together.

The second electrode connection portion 282 is connected to a portion of the second lead portion 222 on the −D1 side. The second electrode connection portion 282 is a member extending along the radial direction, and is disposed on the −D1 side in relation to the first electrode connection portion 281. An inner end portion of the second electrode connection portion 282 is connected to the second lead portion 222, and an outer end portion thereof is exposed on the outer surface of the ceramic heater 40. The exposed portion of the second electrode connection portion 282 is in contact with the inner circumferential surface of the connection member 90. Thus, the connection member 90 and the second lead portion 222 are electrically connected together.

Notably, of the resistor 220, the first straight portion 223*a* and the first lead portion 221 correspond to a first portion 220*a* which extends from the forward end portion of the base member 210 (which is the same as the forward end portion 41 of the ceramic heater 40) toward the rear end portion thereof (which is the same as the rear end portion 49 of the ceramic heater 40), and the second straight portion 223*b* and the second lead portion 222 correspond to a second portion 220*b* which is spaced from the first portion 220*a* and extends from the forward end portion of the base member 210 to the rear end portion thereof.

Figure 2:
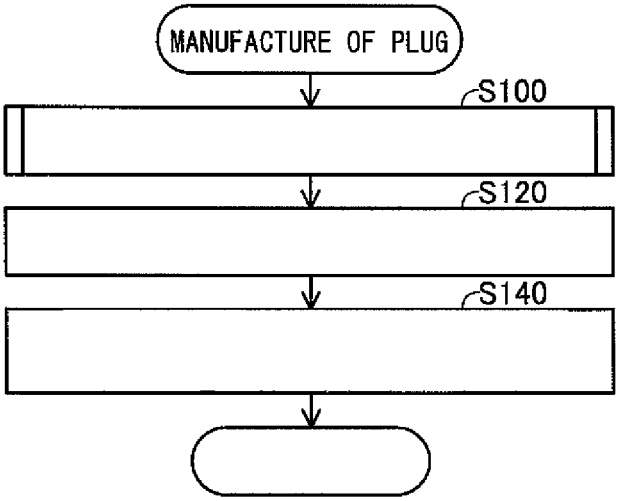
FIG. 2 is a flowchart of one example of a method of manufacturing a glow plug 10.

FIG. 2 is a flowchart of an example of a method of manufacturing the glow plug 10. In the first step S100, the ceramic heater 40 is manufactured. The details of the manufacture of the ceramic heater 40 will be described later. In the next step S120, the members of the glow plug 10, other than the ceramic heater 40, are manufactured. Various known methods can be employed for manufacture of the members other than the ceramic heater 40. Therefore, the detailed description of the methods of manufacturing the members are omitted. Notably, the members of the glow plug 10 may be prepared by purchasing them rather than manufacturing them.

In the next step S140, the glow plug 10 is assembled. Various known methods can be employed for assembly. For example, the heater module 490 is produced by inserting the ceramic heater 40 into the +D1 side opening of the connection member 90. Subsequently, the ceramic heater 40 is press-fitted into the sleeve 70. Also, the center rod 30 is press-fitted into the −D1 side opening of the connection member 90. The rear end portion 39 of the center rod 30 is then inserted into the opening OPa of the metallic shell 20, and the sleeve 70 is press-fitted into the opening OPa of the metallic shell 20. As a result, the ceramic heater 40 is fixed to the metallic shell 20 through the sleeve 70 such that a −D1 side portion of the ceramic heater 40 is disposed inside the metallic shell 20 (specifically, within the through hole 20*x*). Next, the O-ring 50 is fitted onto the rear end portion 39 of the center rod 30, and the insulating member 60 is then fitted onto the rear end portion 39 of the center rod 30. Subsequently, the terminal member 80 is fixed to the rear end portion 39 of the center rod 30 by means of crimping. Thus, the glow plug 10 is completed.

Figure 3A:
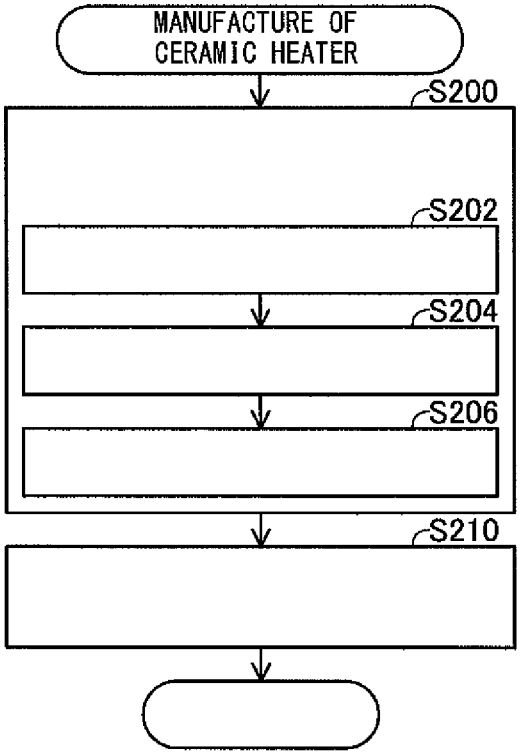
FIGS. 3(A) and 3(B) are explanatory views of a method of manufacturing a ceramic heater 40.
Figure 3B:
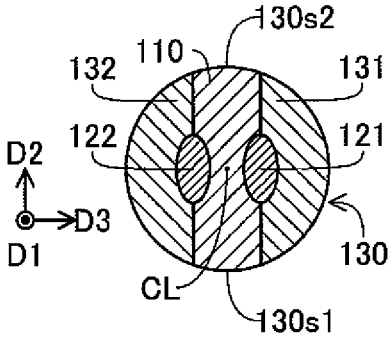

FIG. 3(A) is a flowchart of an example of a method of manufacturing the ceramic heater 40. In the first step S200, a heater green body is produced. The heater green body corresponds to the ceramic heater 40 before being fired. FIG. 3(B) is a cross-sectional view of the heater green body 130. This cross-sectional view shows a cross section corresponding to a cross section of the ceramic heater 40 taken along line Ca-Ca of FIG. 1(B). This cross section is a cross section which is orthogonal to the first direction D1 and which passes through a portion corresponding to the straight portions 223*a* and 223*b* of the heat generation portion 223.

As shown in FIG. 3(B), the cross section of the heater green body 130 is divided into five portions 110, 131, 132, 121, and 122. The two portions 121 and 122 disposed in the heater green body 130 correspond to the straight portions 223*a* and 223*b* of the resistor 220, respectively. The remaining three portions 110, 131, and 132 correspond to the base member 210.

The inner portion 110 sandwiched between the two portions 121 and 122 corresponding to the resistor 220 extends from an outer surface 130*s*1 of the heater green body 130 located on the −D2 side toward an outer surface 130*s*2 thereof located on the +D2 side. The first outer portion 131 disposed on the +D3 side of the inner portion 110 forms an outer surface of the heater green body 130 located on the +D3 side. The first resistor portion 121 corresponding to a portion of the resistor 220 is sandwiched between the inner portion 110 and the first outer portion 131. The second outer portion 132 disposed on the −D3 side of the inner portion 110 forms an outer surface of the heater green body 130 located on the −D3 side. The second resistor portion 122 corresponding to a portion of the resistor 220 is sandwiched between the inner portion 110 and the second outer portion 132.

Such a heater green body 130 is formed by mainly three steps S202, S204, and S206. In step S202, the inner portion 110 (also referred to as the "first green body 110") is formed. In step S204, a portion corresponding to the resistor 220 (including the resistor portions 121 and 122) is formed on the first green body 110. In step S206, the remaining portion of the heater green body 130 (including the outer portions 131 and 132) is formed. The details of these steps S202, S204, and S206 will be described later.

In the next step S210, the produced heater green body 130 is fired. Thus, the ceramic heater 40 is completed.

Figure 4A:
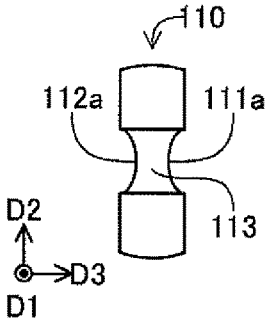
FIGS. 4(A) through 4(D) are schematic views of a first green body 110.
Figure 4B:
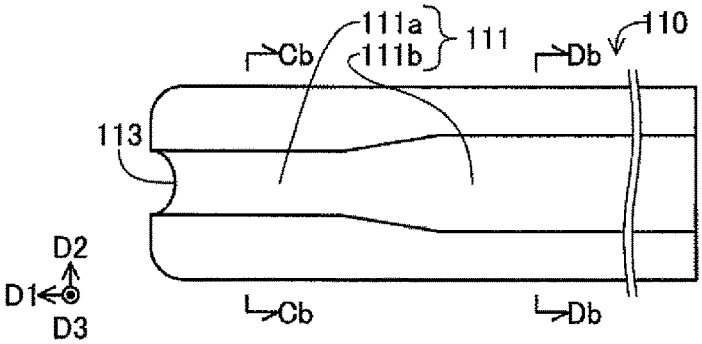
Figure 4C:
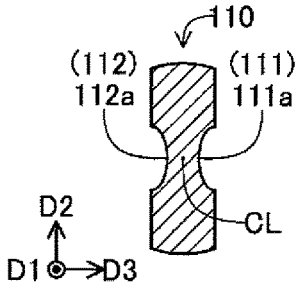
Figure 4D:
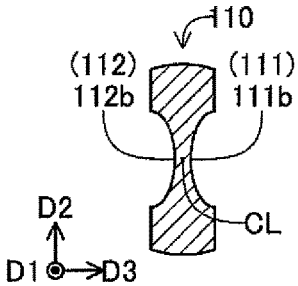

FIGS. 4(A) through 4(D) are schematic views of the first green body 110 produced in step S202 of FIG. 3(A). The directions D1, D2, and D3 in the drawings show the directions determined on the basis of the base member 210 (FIGS. 1(A) and 1(B)) obtained through use of the first green body 110. FIG. 4(A) is a schematic view of the +D1 side end portion of the first green body 110 as viewed toward the −D1 direction. FIG. 4(B) is a schematic view of the +D3 side surface of the first green body 110 as viewed toward the −D3 direction. FIG. 4(C) is a cross section taken along line Cb-Cb of FIG. 4(B), and FIG. 4(D) is a cross section taken along line Db-Db of FIG. 4(B). The cross section shown in FIG. 4(C) corresponds to the cross section taken along line Ca-Ca of FIG. 1(B). The cross section of FIG. 4(D) is a cross section on the −D1 side of the cross section of FIG. 4(C).

As shown in FIG. 4(B), the first green body 110 is a rod-shaped member extending along the first direction D1. The +D3 side surface of the first green body 110 is a flat surface in which a first groove 111 extending along the first direction D1 is formed. As shown in FIGS. 4(A) and 4(B), a forward end groove 113 is formed in an end portion of the first green body 110 on the +D1 side. The forward end groove 113 is a groove extending from the +D3 side of the first green body 110 to the −D3 side thereof. As shown in FIGS. 4(C) and 4(D), the −D3 side surface of the first green body 110 has the same shape as that of the +D3 side surface. Specifically, a second groove 112 having the same shape as the first groove 111 on the +D3 side is formed in the −D3 side surface. As will be described later, these grooves 111, 112, and 113 accommodate an approximately half of a generally U-shaped portion corresponding to the resistor 220 (FIGS. 1(A) and 1(B)), the half being located on the inner circumference side of the generally U-shaped portion. The expression "the inner circumference side of the generally U-shaped portion" refers to the side toward a region surrounded by the generally U-shaped portion.

The first groove 111 includes a first groove forward portion 111*a* which is a portion on the +D1 side (also referred to as the "forward groove portion 111*a*"), and a first groove rear portion 111*b* which is a portion located on the −D1 side in relation to the first groove forward portion 111*a* (also referred to as the "rear groove portion 111*b*"). The forward groove portion 111*a* is thinner and narrower than the rear groove portion 111*b*. The diameter of the groove changes smoothly at a connection region where the forward groove portion 111*a* and the rear groove portion 111*b* are connected. FIG. 4(C) is a cross section passing through the forward groove portion 111*a*. FIG. 4(D) is a cross section passing through the rear groove portion 111*b*.

The −D3 side second groove 112 has the same shape. For example, as shown in FIG. 4(C), a second groove forward portion 112*a* having the same shape as the first groove forward portion 111*a* is formed on the −D3 side of the cross section including the first groove forward portion 111*a*. As shown in FIG. 4(D), a second groove rear portion 112*b* having the same shape as the first groove rear portion 111*b* is formed on the −D3 side of the cross section including the first groove rear portion 111*b*.

As will be described later, the forward end groove 113 and the forward groove portions 111*a* and 112*a* accommodate an inner-circumferential-side part of a portion corresponding to the generally U-shaped heat generation portion 223 of the resistor 220 (FIGS. 1(A) and 1(B)). The first groove rear portion 111*b* (FIG. 4(D)) accommodates an inner-circumferential-side (here, −D3 side) part of a portion corresponding to the first lead portion 221. The second groove rear portion 112*b* (FIG. 4(D)) accommodates an inner-circumferential-side (here, +D3 side) part of a portion corresponding to the second lead portion 222.

FIGS. 5(A) through 5(D) are schematic views showing how the first green body 110 is formed through use of molding dies 911 and 912. Each of FIGS. 5(A) through 5(D) shows a cross section corresponding to the Cb-Cb cross section of FIG. 4(B). The directions D1, D2, and D3 in the drawings show the directions determined on the basis of the base member 210 (FIGS. 1(A) and 1(B)) obtained through use of the first green body 110. Molding of the first green body 110 proceeds in the order of FIGS. 5(A) through 5(D).

Figure 5A:
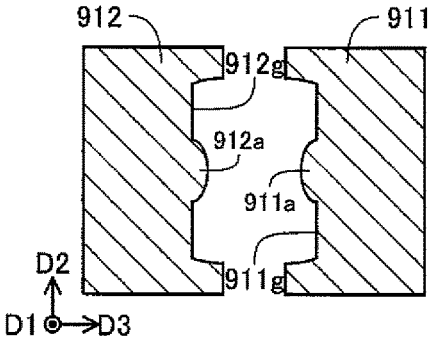
FIGS. 5(A) through 5(D) are schematic views showing how the first green body 110 is formed.

FIG. 5(A) shows the two molding dies 911 and 912. A recess 911*g* concaved toward the +D3 direction is formed on the −D3 side surface of the first die 911 disposed on the +D3 side. The shape of the wall surface of the recess 911*g* is the same as the shape of the outer surface of an approximate half of the first green body 110 located on the +D3 side. A protrusion 911*a* projecting in the −D3 direction is formed in the recess 911*g*. Although not illustrated, the protrusion 911*a* corresponds to the first groove 111 and an approximate half of the forward end groove 113 located on the +D3 side.

A recess 912*g* concaved toward the −D3 direction is formed on the +D3 side surface of the second die 912 disposed on the −D3 side. The shape of the wall surface of the recess 912*g* is the same as the shape of the outer surface of an approximate half of the first green body 110 located on the −D3 side. A protrusion 912*a* projecting in the +D3 direction is formed in the recess 912*g*. Although not illustrated, the protrusion 912*a* corresponds to the second groove 112 and an approximate half of the forward end groove 113 located on the −D3 side.

Figure 5B:
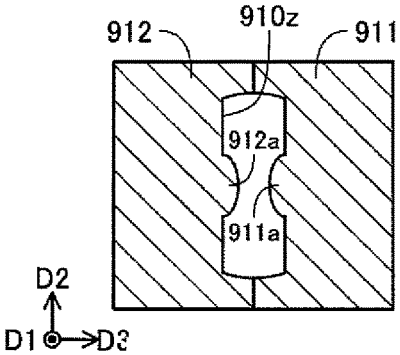

As shown in FIG. 5(B), the two molding dies 911 and 912 are closed. As a result, the two recesses 911*g* and 912*g* form a single cavity 910*z*. The shape of the wall surface of the cavity 910*z* is the same as the shape of the outer surface of the entire first green body 110.

Figure 5C:
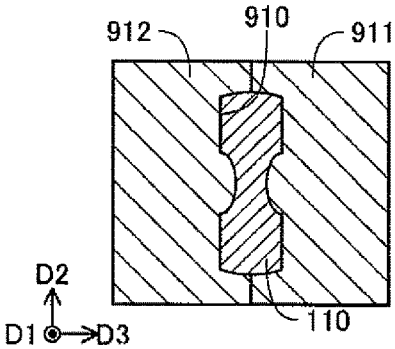
Figure 5D:
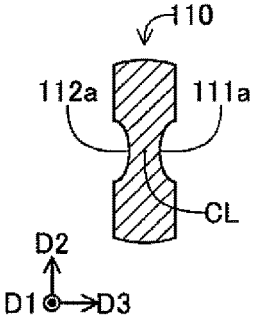

Next, as shown in FIG. 5(C), the material of the base member 210 (e.g., a mixture of silicon nitride and a binder) is injected into the cavity 910*z*. Subsequently, as shown in FIG. 5(D), the molding dies 911 are 912 are removed, whereby the molding of the first green body 110 is completed. Notably, the method of molding the first green body 110 is not limited to injection molding as shown in FIGS. 5(A) through 5(D), and various molding methods such as compression molding may be employed.

Figure 6A:
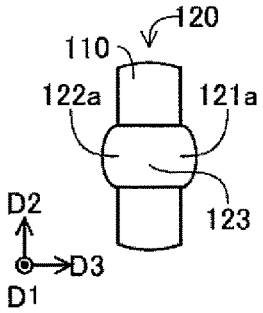
FIGS. 6(A) through 6(D) are schematic views of a second green body 120.
Figure 6B:
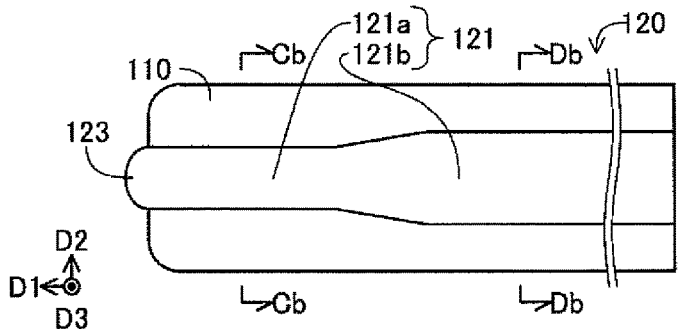
Figure 6C:
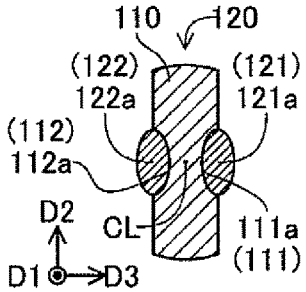
Figure 6D:
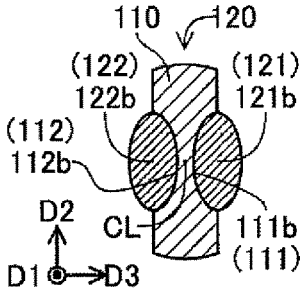

FIGS. 6(A) through 6(D) are schematic views of the second green body 120 produced in step S204 of FIG. 3(A). The second green body 120 is composed of the first green body 110 and a portion corresponding to the resistor 220. FIGS. 6(A) through 6(D) are schematic views showing how the portion corresponding to the resistor 220 is formed on the first green body 110 shown in FIGS. 4(A) through 4(D).

shown in FIG. 6(B), the first resistor portion 121 is formed on the +D3 side of the first green body 110, specifically, on the first groove 111 (FIG. 4(B)). As shown in FIGS. 6(C) and 6(D), the first groove 111 accommodates an approximate half of the first resistor portion 121 on the −D3 side. As shown in FIGS. 6(A) and 6(B), the forward end resistor portion 123 is formed on the +D1 side of the first green body 110, specifically, on the forward end groove 113 (FIG. 4(A) and FIG. 4(B)). The forward end groove 113 accommodates an approximate half of the forward end resistor portion 123 on the inner circumferential side. As shown in FIGS. 6(C) and 6(D), the second resistor portion 122 having the same shape as the first resistor portion 121 is formed on the −D3 side of the first green body 110, specifically, on the second groove 112. The first resistor portion 121, the forward end resistor portion 123, and the second resistor portion 122 are continuous. The first resistor portion 121, the forward end resistor portion 123, and the second resistor portion 122 correspond to the resistor 220.

The first resistor portion 121 includes a first resistor forward portion 121*a* formed on the forward groove portion 111*a* (FIGS. 4(B) and 6(C)) (also referred to as the "forward resistor portion 121*a*"), and a first resistor rear portion 121*b* formed on the rear groove portion 111*b* (FIGS. 4(B) and 6(C)) (also referred to as the "rear resistor portion 121*b*"). The forward resistor portion 121*a* is thinner and narrower than the rear resistor portion 121*b*. Namely, the area of a cross section of the forward resistor portion 121*a* taken orthogonal to the extending direction thereof is smaller than the area of a cross section of the rear resistor portion 121*b* taken orthogonal to the extending direction thereof. The diameter of the resistor portion changes smoothly in a region where the forward resistor portion 121*a* and the rear resistor portion 121*b* are connected.

The second resistor portion on the −D3 side has the same shape. As shown in FIG. 6(C), a second resistor forward portion 122*a* having the same shape as the first resistor forward portion 121*a* is formed on the −D3 side of the cross section including the first resistor forward portion 121*a*. As shown in FIG. 6(D), a second resistor rear portion 122*b* having the same shape as the first resistor rear portion 121*b* is formed on the −D3 side of the cross section including the first resistor rear portion 121*b*.

The first resistor forward portion 121*a* corresponds to the first straight portion 223*a* of the heat generation portion 223 (FIGS. 1(A) and 1(B)). The second resistor forward portion 122*a* corresponds to the second straight portion 223*b* of the heat generation portion 223. The forward end resistor portion 123 corresponds to the connection portion 223*c* of the heat generation portion 223. The first resistor rear portion 121*b* corresponds to the first lead portion 221. The second resistor rear portion 122*b* corresponds to the second lead portion 222.

FIGS. 7(A) through 7(D) are schematic views showing how the second green body 120 is formed through use of molding dies 921 and 922. Each of FIGS. 7(A) through 7(D) shows a cross section corresponding to the Cb-Cb cross section of FIG. 6(B). The directions D1, D2, and D3 in the drawings show the directions determined on the basis of the base member 210 (FIGS. 1(A) and 1(B)) obtained through use of the second green body 120. Molding of the second green body 120 proceeds in the order of FIGS. 7(A) through 7(D).

Figure 7A:
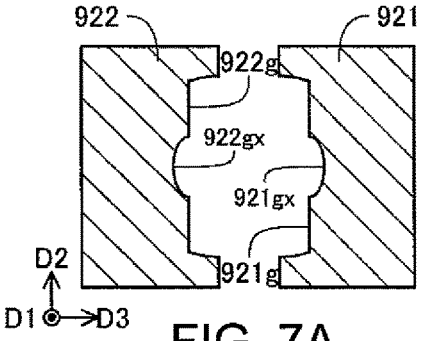
FIGS. 7(A) through 7(D) are schematic views showing how the second green body 120 is formed.

FIG. 7(A) shows the two molding dies 921 and 922. A recess 921*g* concaved toward the +D3 direction is formed on the −D3 side surface of the first die 921 disposed on the +D3 side. The shape of the wall surface of the recess 921*g* is the same as the shape of the outer surface of an approximate half of the second green body 120 located on the +D3 side. A recess 921*gx* concaved in the +D3 direction is formed in the recess 921*g*. Although not illustrated, the recess 921*gx* corresponds to the first resistor portion 121 and an approximate half of the forward end resistor portion 123 located on the +D3 side.

A recess 922*g* concaved toward the −D3 direction is formed on the +D3 side surface of the second die 922 disposed on the −D3 side. The shape of the wall surface of the recess 922*g* is the same as the shape of the outer surface of an approximate half of the second green body 120 located on the −D3 side. A recess 922*gx* concaved in the −D3 direction is formed in the recess 922*g*. Although not illustrated, the recess 922*gx* corresponds to the second resistor portion 122 and an approximate half of the forward end resistor portion 123 located on the −D3 side.

Figure 7B:
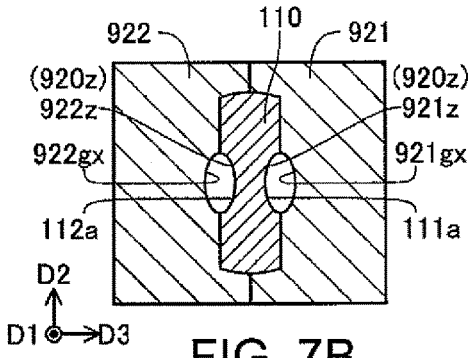

As shown in FIG. 7(B), the two molding dies 921 and 922 are closed in a state in which the first green body 110 is fitted into the recesses 921*g* and 922*g*. The grooves of the first green body 110 (the first groove 111, the forward end groove 113, and the second groove 112) and the recesses 921*gx* and 922*gx* of the molding dies 921 and 922 form a single continuous cavity 920*z*. The shape of the wall surface of the cavity 920*z* is the same as the shape of the outer surface of the entire portion corresponding to the resistor 220 (FIGS. 1(A) and 1(B)). FIG. 7(B) shows a first forward portion 921*z* and a second forward portion 922*z* which are portions of the cavity 920*z*. The first forward portion 921*z* is a portion of the cavity 920*z* surrounded by the first groove forward portion 111*a* and the recess 921*gx*. The second forward portion 922*z* is a portion of the cavity 920*z* surrounded by the second groove forward portion 112*a* and the recess 922*gx*.

Figure 7C:
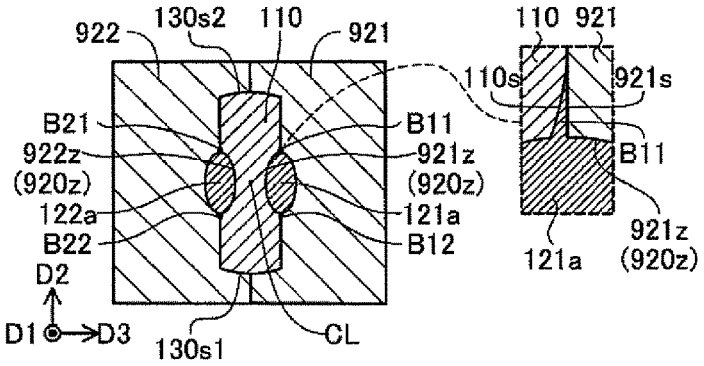

Next, as shown in FIG. 7(C), the material of the resistor 220 (e.g., a mixture of silicon nitride, tungsten carbide, and a binder) is injected into the cavity 920*z*. As a result, resistor portions 121, 122, and 123 corresponding to the resistor 220 are molded.

As shown in the drawings, both the −D2 side outer surface 130*s*1 and the +D2 side outer surface 130*s*2 of the first green body 110 are in contact with the inner surface of the first die 921. Similarly, these outer surfaces 130*s*1 and 130*s*2 are in contact with the inner surface of the second die 922. Accordingly, the positions of the molding dies 921 and 922 in relation to the first green body 110 (namely, the positions of the resistor portions 121, 122, and 123 in relation to the first green body 110) can be determined accurately, with the outer surfaces 130*s*1 and 130*s*2 (namely, the outer surface of the ceramic heater 40) used as a reference. Accordingly, cracking of the ceramic heater 40 due to positional deviation of the dies can be suppressed. Also, variation of heating performance can be suppressed.

When the material of the resistor 220 is injected into the cavity 920*z*, the material enters gaps between the first green body 110 and the molding dies 921 and 922, whereby protrusions B11, B12, B21, and B22 (also referred to as "burrs B11, B12, B21, and B22") are formed. An enlarged view of the burr B11 is shown on the right side of FIG. 7(C). The drawing shows a region near the +D2 side end of the first forward portion 921*z* of the cavity 920*z*. As shown in the drawing, the +D3 side surface 110*s* of the first green body 110 is in contact with the −D3 side surface 921*s* of the first die 921. However, in the vicinity of the cavity 920*z* (the first forward portion 921*z*), a gap is produced between these surfaces 110*s* and 921*s*. As a result of the material of the resistor 220 entering the gap, the burr B11 is formed. The burr B11 is a straight protrusion extending parallel to the D1 direction. Similarly, the burr B12 is formed at the −D2 side end of the first forward portion 921*z* of the cavity 920*z*, the burr B21 is formed at the +D2 side end of the second forward portion 922*z* of the cavity 920*z*, and the burr B22 is formed at the −D2 side end of the second forward portion 922*z* of the cavity 920*z*. The relation between the positions of the burrs and cracks produced in the ceramic heater 40 will be described later.

Figure 7D:
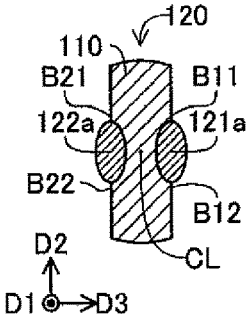

After completion of the injection, as shown in FIG. 7(D), the molding dies 921 are 922 are removed, whereby the molding of the second green body 120 is completed. Notably, the method of molding the second green body 120 (in particular, the portion corresponding to the resistor 220) is not limited to injection molding as shown in FIGS. 7(A) through 7(D), and various molding methods such as compression molding may be employed.

FIGS. 8(A) through 8(D) are schematic views of the third green body 130 (the heater green body 130) produced in step S206 of FIG. 3(A). The third green body 130 is composed of the second green body 120 and a part of the portion corresponding to the base member 210 (FIGS. 1(A) and 1(B)) remaining after exclusion of the first green body 110. FIGS. 8(A) through 8(D) are schematic views showing how the remaining part of the portion corresponding to the base member 210 is formed on the second green body 120 shown in FIGS. 6(A) through 6(D).

Figure 8A:
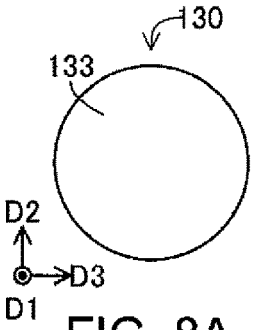
FIGS. 8(A) through 8(D) are schematic views of a third green body 130 (a heater green body 130).
Figure 8B:
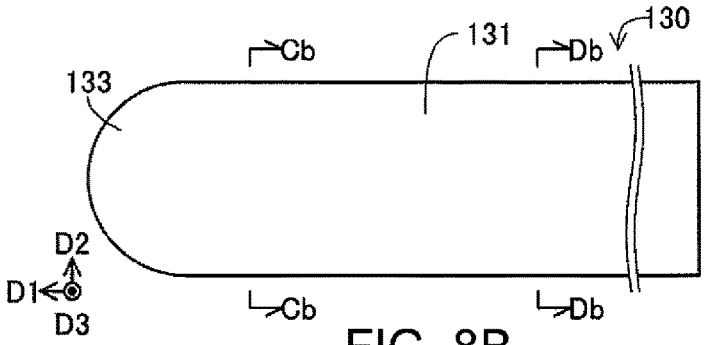
Figure 8C:
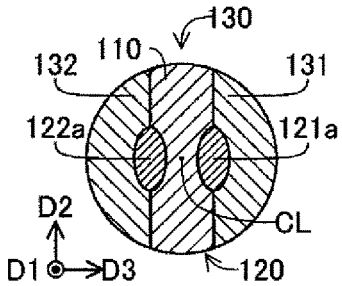
Figure 8D:
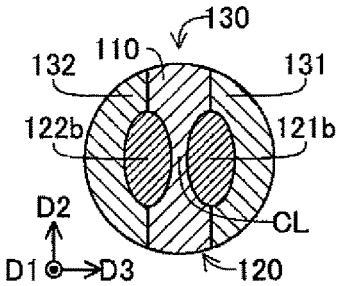

As shown in FIG. 8(B) through 8(D), a first outer portion 131 is formed on the +D3 side of the second green body 120. The first outer portion 131 covers the entirety of the outer surface of the second green body 120 located on the +D3 side. A second outer portion 132 is formed on the −D3 side of the second green body 120. The second outer portion 132 covers the entirety of the outer surface of the second green body 120 located on the −D3 side. As shown in FIGS. 8(A) and 8(B), a forward end portion 133 is formed on the +D1 side of the second green body 120. The forward end portion 133 covers the +D1 side end of the second green body 120. These portions 131, 132, and 133 correspond to the remaining part of the portion corresponding to the base member 210 remaining after exclusion of the first green body 110.

FIGS. 9(A) through 9(D) are schematic views showing how the third green body 130 is formed through use of molding dies 931 and 932. Each of FIGS. 9(A) through 9(D) shows a cross section corresponding to the Cb-Cb cross section of FIG. 8(B). The directions D1, D2, and D3 in the drawings show the directions determined on the basis of the ceramic heater 40 (FIGS. 1(A) and 1(B)) obtained through use of the third green body 130. Molding of the third green body 130 proceeds in the order of FIGS. 9(A) through 9(D).

Figure 9A:
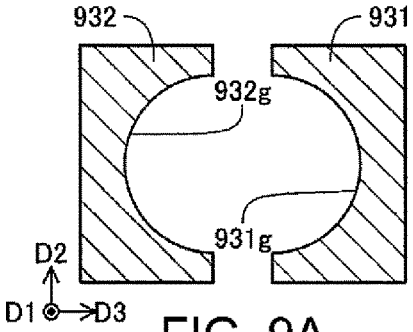
FIGS. 9(A) through 9(D) are schematic views showing how the third green body 130 is formed.

FIG. 9(A) shows the two molding dies 931 and 932. A recess 931*g* concaved toward the +D3 direction is formed on the −D3 side surface of the first die 931 disposed on the +D3 side. The shape of the wall surface of the recess 931*g* is the same as the shape of the outer surface of an approximate half of the third green body 130 located on the +D3 side. A recess 932*g* concaved toward the −D3 direction is formed on the +D3 side surface of the second die 932 disposed on the −D3 side. The shape of the wall surface of the recess 932*g* is the same as the shape of the outer surface of an approximate half of the third green body 130 located on the −D3 side.

Figure 9B:
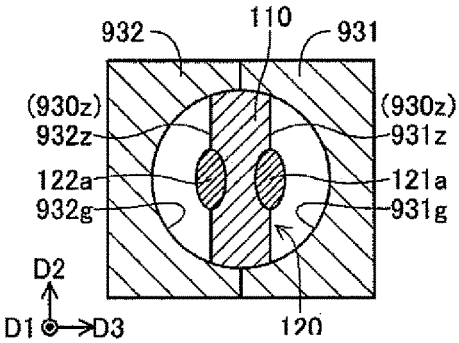

As shown in FIG. 9(B), the two molding dies 931 and 932 are closed in a state in which the second green body 120 is fitted into the recesses 931*g* and 932*g*. The outer surface of the second green body 120 and the wall surfaces of the recesses 931*g* and 932*g* of the molding dies 931 and 932 form a single continuous cavity 930*z*. The shape of the wall surface of the cavity 930*z* is the same as the shape of the outer surface of the entirety of the remaining part of the portion corresponding to the base member 210 remaining after exclusion of the first green body 110.

FIG. 9(B) shows a first forward portion 931*z* and a second forward portion 932*z* which are portions of the cavity 930*z*. The first forward portion 931*z* is a portion of the cavity 930*z* surrounded by the +D3 side outer surface of the second green body 120 and the recess 931*g*. The second forward portion 932*z* is a portion of the cavity 930*z* surrounded by the −D3 side outer surface of the second green body 120 and the recess 932*g*.

Figure 9C:
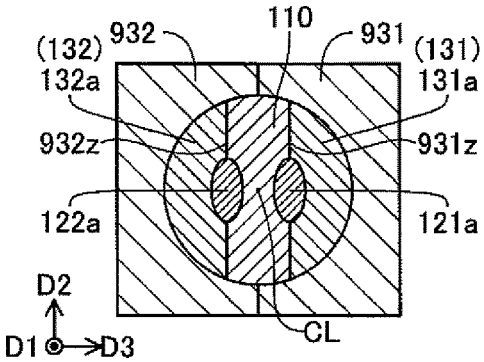
Figure 9D:
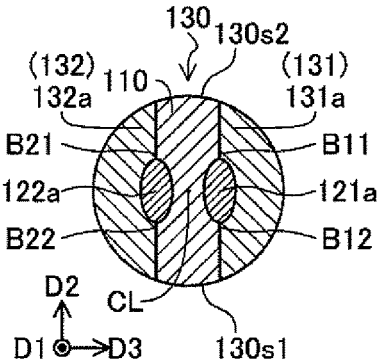

Next, as shown in FIG. 9(C), the material of the base member 210 is injected into the cavity 930*z*. Subsequently, as shown in FIG. 9(D), the molding dies 931 and 932 are removed, whereby the molding of the third green body 130 is completed. As shown in FIG. 9(D), the burrs B11 and B12 of the first resistor forward portion 121*a* are sandwiched between the first green body 110 and the first outer portion 131, and the burrs B21 and B22 of the second resistor forward portion 122*a* are sandwiched between the first green body 110 and the second outer portion 132. Notably, the method of molding the third green body 130 (in particular, the remaining part of the portion corresponding to the base member 210) is not limited to injection molding as shown in FIGS. 9(A) through 9(D), and various molding methods such as compression molding may be employed.

Figure 10:
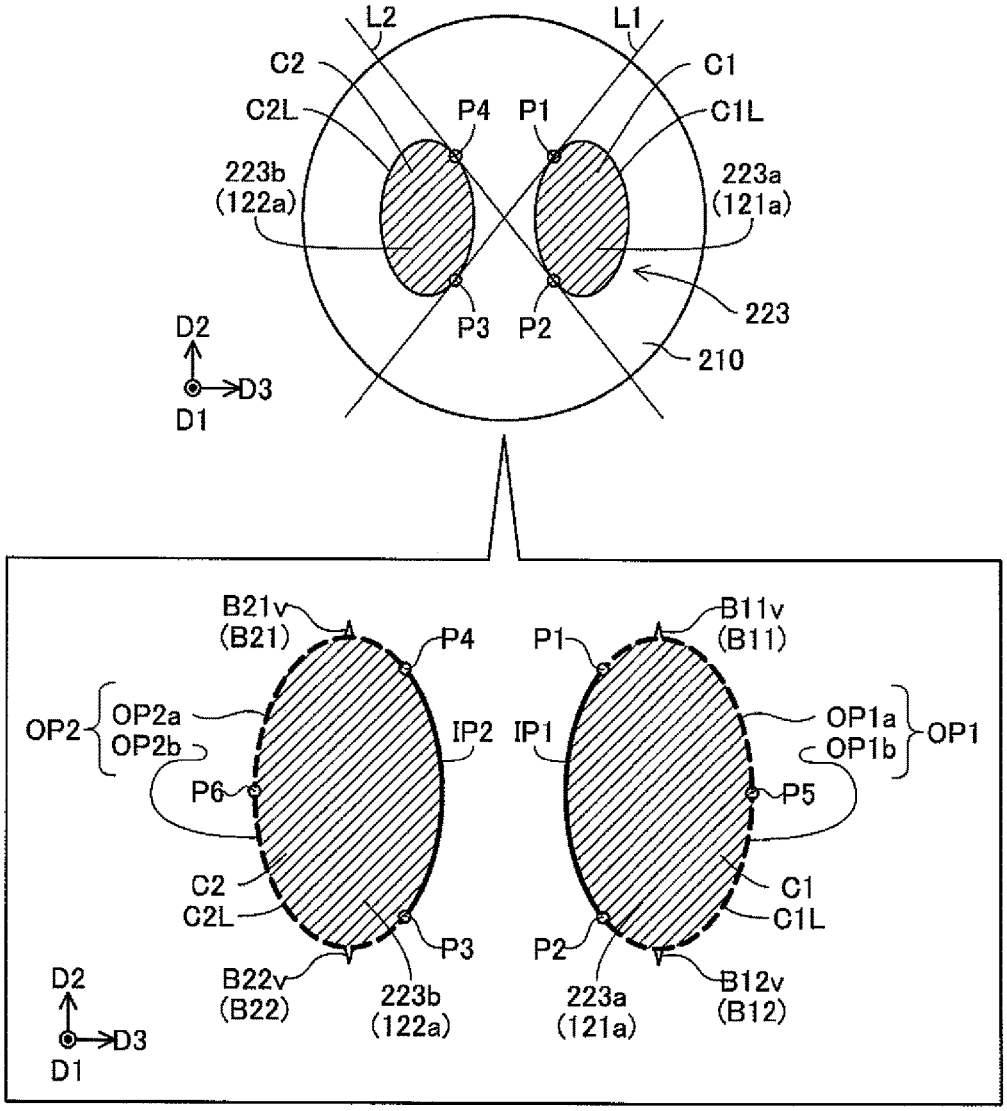
FIG. 10 is a cross-sectional view of the ceramic heater 40.

Next, there will be described the relation between the positions of burrs and cracks which may be produced in the ceramic heater 40. FIG. 10 is a Ca-Ca cross section of the ceramic heater 40 shown in FIG. 1(B). This cross section includes cross sections of the first and second straight portions 223*a* and 223*b* of the heat generation portion 223 embedded in the base member 210. In the following description, the cross section of the first straight portion 223*a* is also referred to as a "first resistor cross section C1;" and the cross section of the second straight portion 223*b* is also referred to as a "second resistor cross section C2." The contour of the first resistor cross section C1 is referred to as a "first contour C1L," and the contour of the second resistor cross section C2 is referred to as a "second contour C2L." Enlarged views of these resistor cross sections C1 and C2 are shown on the lower side of FIG. 10. In the present embodiment, each of the resistor cross sections C1 and C2 has an approximately elliptical shape.

In the drawing, two straight lines L1 and L2 are shown. Each of these straight lines is a tangential line which is tangent to both of the first contour C1L and the second contour C2L. The first straight line L1 is in contact with the first contour C1L at a first position P1 on the −D3 side of a +D2 side portion of the first contour C1L, and is in contact with the second contour C2L at a third position P3 on the +D3 side of a −D2 side portion of the second contour C2L. The second straight line L2 is in contact with the first contour C1L at a second position P2 on the −D3 side of a −D2 side portion of the first contour C1L, and is in contact with the second contour C2L at a fourth position P4 on the +D3 side of a +D2 side portion of the second contour C2L. Each of the straight lines L1 and L2 is a straight line which passes between the first resistor cross section C1 and the second resistor cross section C2 and intersect each other between the first resistor cross section C1 and the second resistor cross section C2. In the case where each of the resistor cross sections C1 and C2 has a circular shape, the two straight lines L1 and L2 are also referred to as "internal common tangents."

As shown in the enlarged view on the lower side of FIG. 10, the first contour C1L is divided into two portions IP1 and OP1 by the two positions P1 and P2. Of the two portions IP1 and OP1, the portion IP1 located on the side toward the second resistor cross section C2 is referred to as a "first inner portion IP1," and the portion OP1 located on the side opposite the second resistor cross section C2 is referred to as a "first outer portion OP1." Similarly, the second contour C2L is divided into two portions 1P2 and OP2 by the two positions P3 and P4. Of the two portions IP2 and OP2, the portion 1P2 located on the side toward the first resistor cross section C1 is referred to as a "second inner portion IP2," and the portion OP2 located on the side opposite the first resistor cross section C1 is referred to as a "second outer portion OP2."

Upon energization, the first straight portion 223*a*, the second straight portion 223*b*, and the connection portion 223*c* of the heat generation portion 223 (FIGS. 1(A) and 1(B)) serve as heat sources and increase in temperature. Accordingly, upon energization, the temperature of a region of the ceramic heater 40 surrounded by the heat generation portion 223; i.e., the temperature of a region sandwiched between the two straight portions 223*a* and 223*b*, becomes highest. On the first contour C1L, the temperature of the first inner portion IP1 becomes higher than that of the first outer portion OP1. On the second contour C2L, the temperature of the second inner portion IP2 becomes higher than that of the second outer portion OP2.

The enlarged view on the lower side of FIG. 10 shows burrs B11*v* and B12*v* of the first straight portion 223*a* and burrs B21*v* and B22*v* of the second straight portion 223*b*. These burrs B11*v*, B12*v*, B21*v*, and B22*v* correspond to the burrs B11, B12, B21, and B22 described with reference to FIG. 7(C). As shown in the enlarged view, the burrs B11*v*, B12*v*, B21*v*, and B22*v* are formed on the outer portions OP1 and OP2, not on the inner portions IP1 and IP2.

Since the base member 210 and the resistor 220 differ in material, a difference in the coefficient of thermal expansion may arise therebetween. In the case where the base member 210 and the resistor 220 differ in the coefficient of thermal expansion, due to a difference between the temperature at the time when the ceramic heater 40 is energized and the temperature at the time when the ceramic heater 40 is not energized, stress may be produced at the boundary between the base member 210 and the resistor 220. When such stress is produced in the vicinity of the burrs, cracks become more likely to be generated. As compared with the outer portions OP1 and OP2, the inner portions IP1 and IP2 have higher temperatures when the ceramic heater 40 is energized; i.e., the inner portions IP1 and IP2 are larger in terms of the difference in temperature between periods during which the ceramic heater 40 is energized and periods during which the ceramic heater 40 is not energized. Accordingly, as compared with the outer portions OP1 and OP2, the inner portions IP1 and IP2 receive larger stresses attributable to the difference in the coefficient of thermal expansion between the base member 210 and the resistor 220.

It is assumed that burrs are formed on the inner portions 1P1 and IP2. In this case, since stresses produced near the burrs are strong, the possibility that cracks are produced near the burrs is high. In contrast, in the present embodiment, no burr is formed on the inner portions IP1 and IP2, and the burrs B11*v*, B12*v*, B21*v*, and B22*v* are formed on the outer portions OP1 and OP2. Accordingly, stresses produced near the burrs are weak, and the possibility that cracks are produced near the burrs can be reduced.

The two burrs B11*v* and B12*v* are formed on the first outer portion OP1. Like this, two burrs B11*v* and B12*v* projecting toward the base member 210 are formed in a single first resistor cross section C1. Accordingly, as compared with the case where the total number of burrs (i.e., protrusions) is one or less, the area of contact between the first resistor cross section C1 and the base member 210 can be increased. Also, as compared with the case where the total number of burrs is one or less, movement of the first resistor cross section C1 relative to the base member 210 can be suppressed to a greater degree. These enhance the close adhesion between the first resistor cross section C1 (i.e., the resistor 220) and the base member 210. Accordingly, the possibility of generation of cracks at the boundary between the resistor 220 and the base member 210 can be decreased. Such enhancement of the close adhesion is also realized in a state before firing. Similarly, two burrs B21*v* and B22*v* projecting toward the base member 210 are formed in a single second resistor cross section C2. Accordingly, the close adhesion between the second resistor cross section C2 (i.e., the resistor 220) and the base member 210 can be enhanced.

The enlarged view on the lower side of FIG. 10 shows a fifth position P5 at which the first outer portion OP1 is divided into two equi-length portions OP1*a* and OP1*b* which are two portions having the same length. In the present embodiment, the fifth position P5 is a position of an end on the +D3 side. One burr B11*v* is formed on the equi-length portion OP1*a* on the +D2 side, and one burr B12*v* is formed on the equi-length portion OP1*b* on the −D2 side. Like this, at least one burr is provided on each of the equi-length portions OP1*a* and OP1*b*. Accordingly, as compared with the case where a burr is provided on one equi-length portion and no burr is provided on the other equi-length portion, a plurality of burrs are disposed in a dispersed manner. Therefore, the close adhesion between the resistor 220 and the base member 210 can be enhanced.

Similarly, the enlarged view shows a sixth position P6 at which the second outer portion OP2 is divided into two equi-length portions OP2*a* and OP2*b* which are two portions having the same length. In the present embodiment, the sixth position P6 is a position of an end on the −D3 side. One burr B21*v* is formed on the equi-length portion OP2*a* on the +D2 side, and one burr B22*v* is formed on the equi-length portion OP2*b* on the −D2 side. Like this, at least one burr is provided on each of the equi-length portions OP2*a* and OP2*b*. Accordingly, the close adhesion between the resistor 220 and the base member 210 can be enhanced.

The ceramic heater 40 having no burr on the inner portions IP1 and IP2 can be readily manufactured through use of the manufacturing method of FIG. 3(A). In the manufacturing method of FIG. 3(A), the first green body 110 is first molded (S202). The first green body 110 is a portion of the base member 210 which includes a part (i.e., the first groove 111 (FIGS. 4(A) through 4(D)), which part is to come into contact with the first inner portion IP1 (FIG. 10), and a part (i.e., the second groove 112), which part is to come into contact with the second inner portion IP2. The first groove 111 is formed by a single molding die 911 (specifically, the protrusion 911*a*). Accordingly, formation of projections and depressions (e.g. burrs) on the surface of the first groove 111 can be suppressed by making the surface of the molding die 911 (the protrusion 911*a*) smooth. Similarly, the second groove 112 is formed by a single molding die 912 (specifically, the protrusion 912*a*). Accordingly, formation of projections and depressions on the surface of the second groove 112 can be suppressed by making the surface of the molding die 912 (the protrusion 912*a*) smooth.

Next, a portion corresponding to the resistor 220 is molded on the first green body 110 (S204). As described above, neither projections nor depressions are formed on the portions (here, the grooves 111 and 112) of the surfaces of the first green body 110, which portions are to come into contact with the inner portions IP1 and IP2. Therefore, formation of protrusions on the inner portions IP1 and 1P2 is suppressed.

Notably, the first green body 110 forms portions of the outer surface of the base member 210 (specifically, outer surfaces corresponding to the outer surfaces 130*s*1 and 130*s*2 shown in FIG. 3(B) and FIG. 8(D)). As having been described with reference to FIG. 7(C), the positions of the portions 121, 122, and 123 corresponding to the resistor 220, in relation to the first green body 110, are accurately determined, with the outer surfaces 130*s*1 and 130*s*2 used as references. Namely, the accuracy of the positioning of the resistor 220 in relation to the outer surface of the base member 210 (namely, the outer surface of the ceramic heater 40) can be improved. As a result, cracks stemming from positioning deviation can be suppressed.

(1) From the viewpoint of enhancing the close adhesion between the base member 210 (FIG. 10) and the resistor 220, it is preferred that the total number of protrusions provided on the first outer portion OP1 be large. For example, the total number of protrusions may be "3" or more. It is preferred that the total number of the protrusions of the first equi-length portion OP1*a* be 1 or more and the total number of the protrusions of the second equi-length portion OP1*b* be 1 or more. However, at least one of the total number of the protrusions of the first equi-length portion OP1*a* and the total number of the protrusions of the second equi-length portion OP1*b* may be zero. The above description can apply similarly to the protrusions of the second outer portion OP2.

Three or more protrusions may be formed on each of the outer portions OP1 and OP2 by, for example, the following method. Namely, the two molding dies shown in FIGS. 7(A) through 7(C) and used for molding the second green body 120 may be configured such that one molding die molds a half of the second green body 120 on the +D2 side, and the other molding die molds a half of the second green body 120 on the −D2 side. The shape of a cavity formed by closing the two molding dies in a state in which the first green body 110 is accommodated therein is the same as that of the cavity 920*z* described with reference to FIG. 7(B). However, lines of joint between the two molding dies are disposed on the +D3 side of the first forward portion 921*z* (FIG. 7(B)) and on the −D3 side of the second forward portion 922*z*. Accordingly, the first resistor forward portion 121*a* (FIG. 7(D)) has not only the two burrs B11 and B12, but also a third burr formed on the +D3 side surface thereof. Similarly, the second resistor forward portion 122*a* has not only the two burrs B21 and B22, but also a third burr formed on the −D3 side surface thereof Notably, either of the total number of the protrusions of the first outer portion OP1 and the total number of the protrusions of the second outer portion OP2 may be "1" or "zero." In either case, when at least one of the total number of the protrusions of the first outer portion OP1 and the total number of the protrusions of the second outer portion OP2 is "2" or greater, the close adhesion between the base member 210 and the resistor 220 can be enhanced as compared with the case where both the total number of the protrusions of the first outer portion OP1 and the total number of the protrusions of the second outer portion OP2 are 1 or less.

(2) The protrusions formed on the resistor cross sections C1 and C2 (FIG. 10) are not limited to burrs (namely, protrusions formed at positions where the plurality of molding dies meet (also called "parting lines") or at positions where a green body and the molding dies meet). Protrusions intentionally formed by recesses provided on the molding dies may be employed.

(3) The shape of the first resistor cross section C1 (FIG. 10) is not limited to an elliptical shape, and an arbitrary shape may be employed. For example, a circular shape, a rectangular shape, or a U-like shape may be employed. Similarly, various shapes may be employed for the second resistor cross section C2.

In each case, in a cross section of the ceramic heater (a cross section orthogonal to the axial direction), the temperature of a region sandwiched between the first resistor cross section C1 and the second resistor cross section C2 is likely to become high as compared with other regions. Accordingly, a portion of the first contour C1L where temperature becomes relatively high can be specified by two tangential lines which are tangent to the first contour C1L and the second contour C2L and which pass between the first resistor cross section C1 and the second resistor cross section C2, irrespective of the shape of the first resistor cross section C1 and the shape of the second resistor cross section C2 (such two tangential line intersect each other between the first resistor cross section C1 and the second resistor cross section C2). In the example of FIG. 10, the first inner portion IP1 is determined by the two tangential lines L1 and L2. A portion of the second contour C2L where temperature becomes relatively high can be specified similarly. A straight line which is tangent to a contour but does not intersect with the contour can be employed as a tangential line which is tangent to the contour.

Irrespective of the shapes of the first and second resistor cross sections, and irrespective of the number of protrusions provided on the first outer portion determined by the two tangential lines (the first outer portion OP1 in the example of FIG. 10) and the number of protrusions provided on the second outer portion determined by the two tangential lines (the second outer portion OP2 in the example of FIG. 10), it is preferred that the following configuration be employed. Namely, it is preferred that the first resistor cross section have no protrusion on the first inner portion of the first contour (the first inner portion IP1 in the example of FIG. 10), and the second resistor cross section have no protrusion on the second inner portion of the second contour (the second inner portion 1P2 in the example of FIG. 10). This configuration decreases the possibility of cracking of the ceramic heater, because no protrusion is provided on portions of the first and second contours where temperature becomes relatively high (the inner portions IP1 and IP2 in the example of FIG. 10).

(4) The cross-sectional shape (specifically, the shape of a cross section orthogonal to the axial direction) of the first green body 110 is not limited to that described with reference to FIGS. 4(A) through 4(D), and various shapes can be employed. For example, the cross-sectional shape of the first groove 111 may be defined by a plurality of straight line segments. For example, the first groove 111 may have a V-shaped cross sectional shape. Also, the entirety of the +D3 side surface of the first green body 110 may be defined by a curve. This also applies to the −D3 side surface thereof.

The portions of the outer surface of the base member 210 (namely, the outer surface of the ceramic heater 40), which portions are formed by the first green body 110, are not limited to the two portions 130*s*1 and 130*s*2 disposed on the opposite sides of the center axis CL, and arbitrary portions may be formed by the first green body 110. For example, the first green body 110 may configured such that it has a portion for forming the first outer surface 130*s*1 but a portion for forming the second outer surface 130*s*2 is omitted. Also, all the portions for forming the outer surface may be omitted from the first green body 110. However, in order to improve the accuracy of positioning of the resistor 220 relative to the base member 210, it is preferred that the first green body 110 form at least a portion of the outer surface, and the portions 121, 122, and 123 corresponding to the resistor 220 be formed on the first green body 110 through use of a molding die which comes into contact with the outer surface formed by the first green body 110.

(5) In the above-described embodiment and modifications, with reference to FIG. 10, there has been described the cross-sectional configuration of a portion of the ceramic heater 40 which has the highest temperature when the ceramic heater 40 is energized. However, the above-described various cross-sectional configurations may be realized at a portion other than the portion where temperature becomes highest when the ceramic heater 40 is energized. In the case where the resistor of the ceramic heater includes a first portion extending from the forward end portion of the base member toward the rear end portion thereof (the first portion 220*a* in the example of FIGS. 1(A) and 1(B)) and a second portion spaced from the first portion and extending from the forward end portion of the base member toward the rear end portion thereof (the second portion 220*b* in the example of FIGS. 1(A) and 1(B)), even in a cross section of a portion different from the portion where temperature becomes highest when the ceramic heater 40 is energized, the temperature of a region sandwiched between the first portion and the second portion is likely to become higher than those of other regions. Accordingly, the cross section in which the above-described various cross-sectional configurations are realized is not limited to the cross section of the portion where temperature becomes highest upon energization, and it is preferred that at least a portion of the above-described various cross-sectional configurations be realized at least in one of cross sections of the ceramic heater orthogonal to the axial direction. This configuration decreases the possibility of cracking of the ceramic heater.

(6) In the above-described embodiment and modifications, it is preferred that the height of each protrusion (for example, the burr B11*v* of FIG. 10) in the cross section of the ceramic heater orthogonal to the axial direction fall within a range of 10 μm to 100 μm inclusive. In the case where the height of each protrusion is less than 10 μm, the effect of enhancing the close adhesion between the base member 210 and the resistor 220 may become weak. Also, in the case where the height of each protrusion is greater than 100 μm, the size of the ceramic heater may increase.

Similarly, it is preferred that the maximum width of each protrusion (for example, the burr B11*v* of FIG. 10) in the cross section of the ceramic heater orthogonal to the axial direction fall within a range of 10 μm to 100 μm inclusive. In the case where the maximum width of each protrusion is less than 10 μm, the protrusion may become more likely to be broken. Also, in the case where the maximum width of each protrusion is grater than 100 μm, the size of the ceramic heater may increase.

(7) The method of manufacturing the ceramic heater is not limited to the method described with reference to FIGS. 4(A)-4(D) through FIGS. 9(A)-9(D), and various methods can be employed. For example, the first green body 110 may be molded on a portion by portion basis through a plurality of times of molding. In this case, the entirety of the plurality of times of molding corresponds to a step of molding the first green body 110.

The second green body 120; specifically, a portion corresponding to the resistor 220 (specifically, the resistor portions 121, 122, and 123 shown in FIGS. 6(A)-6(D)) may be molded on a portion by portion basis through a plurality of times of molding. In this case, the entirety of the plurality of times of molding corresponds to a step of molding the portion corresponding to the resistor 220.

The third green body 130; specifically, a part of the portion corresponding to the base member 210 remaining after exclusion of the first green body 110 may be molded on a portion by portion basis through a plurality of times of molding. In this case, the entirety of the plurality of times of molding corresponds to a step of molding the part (remaining part) of the portion corresponding to the base member 210 other than the first green body 110.

(8) The structure of the ceramic heater is not limited to the structure described with reference to FIGS. 1(A) and 1(B), and various structures may be employed. For example, the shape of the second portion 220*b* may differ from the shape of the first portion 220*a*. In this case, the shape of the second resistor cross section C2 may differ from the shape of the first resistor cross section C1. Also, various electrodes electrically connected to the resistor 220 may be fixed to the ceramic heater 40. The structure of the electrode is not limited to the cylindrical tubular connection member 90, and a rod-shaped electrically conductive member or a plate-shaped electrically conductive member may be employed. In either case, the heater module including the ceramic heater 40 and the electrode can be manufactured by fixing the electrode to the ceramic heater 40 (for example, brazing, welding or press-fitting).

(9) The structure of the glow plug 10 is not limited to the structure described with reference to FIGS. 1(A) and 1(B), and various structures may be employed. For example, various methods other than crimping may be employed so as to fix the terminal member 80 to the center rod 30. For example, there may be employed a structure in which a male screw is formed on the rear end portion 39, a female screw is formed on the terminal member 80, and the terminal member 80 is screwed onto the rear end portion 39. Also, the method of fixing the ceramic heater 40 to the metallic shell 20 is not limited to a method in which the sleeve 70 is interposed therebetween, and various methods, such as a method of press-fitting the ceramic heater 40 into the through hole 20*x*, cab be employed. Also, the entirety of the ceramic heater 40 may be disposed in the through hole 20*x* of the metallic shell 20.

(10) The glow plugs according to the above-described embodiment and modifications are not limited to a glow plug used for assisting startup of an internal combustion engine, and can be applied to various glow plugs. For example, the glow plug according to the above-described embodiment can be applied to glow plugs utilized in various apparatuses such as an exhaust gas heater apparatus for heating exhaust gas, a burner system for reactivating a catalyst or a diesel particulate filter (DPF), and a water heater apparatus for heating cooling water.

Also, the ceramic heater can be applied not only to glow plugs but also to various apparatuses. For example, the ceramic heater can be applied to a soldering iron.

Although the present invention has been described on the basis of the embodiment and modifications thereof, the above-mentioned mode of the invention is provided so as to facilitate the understanding of the invention and does not limit the present invention. The present invention may be modified or improved without departing from the spirit and scope of the claims, and encompasses equivalents thereof.

LIST OF REFERENCES

Glow plug 10
Metallic shell 20
Through hole 20*x*
Male screw portion 22
Tool engagement portion 28
Center rod 30
Forward end portion 31
Rear end portion 39
Ceramic heater 40
Forward end portion 41
Rear end portion 49
O-ring 50
Insulating member 60
Tubular portion 62
Flange portion 68
Metal sleeve 70
Through hole 70*x*
Terminal member 80
Connection member 90
First green body (inner portion) 110
First groove 111
First groove forward portion 111*a*
(Forward groove portion)
First groove rear portion 111*b*
(Rear groove portion)
Second groove 112
Second groove forward portion 112*a*
Second groove rear portion 112*b*
Forward end groove 113
Second green body 120
First resistor portion 121
First resistor forward portion 121*a*
(Forward resistor portion)
First resistor rear portion 121*b*
(Rear resistor portion)
Second resistor portion 122
Second resistor forward portion 122*a*
Second resistor rear portion 122*b*
Forward end resistor portion 123
Third green body 130
(Heater green body)
First outer surface 130*s*1
Second outer surface 130*s*2
First outer portion 131
Second outer portion 132
Forward end portion 133
Base member 210
Resistor 220
First portion 220*a*
Second portion 220*b*
First lead portion 221
Second lead portion 222
Heat generation portion 223
First straight portion 223*a*
Second straight portion 223*b*
Connection portion 223*c*
First electrode connection portion 281
Second electrode connection portion 282
Heater module 490
Cavity 910*z*
Molding die (first die) 911
Protrusion 911*a*
Recess 911*g*
Molding die (second die) 912
Protrusion 912*a*
Recess 912*g*
Cavity 920*z*
Molding die (first die) 921
Recess 921*g*
Surface 921*s*
First forward portion 921*z*
Recess 921*gx*
Second die 922
Recess 922*g*
Second forward portion 922*z*
Recess 922*gx*
Cavity 930*z*
Molding die (first die) 931
Recess 931*g*
First forward portion 931*z*
Second die 932
Recess 932*g*
Second forward portion 932*z*
Burr (protrusion) B11, B12, B21, B22
Burr (protrusion) B11*v*, B12*v*, B21*v*, B22*v*
First equi-length portion OP1*a*
Second equi-length portion OP1*b*
Equi-length portion OP2*a*, OP2*b*
First direction D1
First resistor cross section C1
First straight line L1
First position P1
Second resistor cross section C2
Second straight line L2
Second position P2
Third position P3
Fourth position P4
Fifth position P5
Sixth position P6
Center axis (axial line) CL
First contour C1L
Second contour C2L
Opening OPa
First inner portion IP1
First outer portion OP1
Opening OPb
Second inner portion IP2
Second outer portion OP2

Having described the invention, the following is claimed:

1. A ceramic heater comprising:

a resistor which generates heat when energized; and a base member which extends along an axial direction and in which the resistor is embedded, the base member being formed of a ceramic material which is lower in electrical conductivity than the resistor, wherein the resistor includes a first portion extending from a forward end portion of the base member toward a rear end portion thereof, a second portion spaced from the first portion and extending from the forward end portion of the base member toward the rear end portion thereof, and a connection portion embedded in the forward end portion of the base member and connecting the first portion and the second portion; and in a cross section of the ceramic heater taken orthogonal to the axial direction, a first resistor cross section taken through the first portion of the resistor and a second resistor cross section taken through the second portion of the resistor, the first cross-section being spaced from the second cross-section, with two straight lines which are in contact with both a peripheral contour of the first resistor cross section and a peripheral contour of the second resistor cross section and which pass between the first resistor cross section and the second resistor cross section in the cross section of the ceramic heater being defined as a first straight line and a second straight line, the first resistor cross section has no protrusion on a first inner portion, the first inner portion being that portion of the contour of the first resistor cross section that is located on the side of the first resistor cross section that faces toward the second resistor cross section, the first inner portion extending from a first position at which the contour of the first resistor cross section is in contact with the first straight line to a second position at which the contour of the first resistor cross section is in contact with the second straight line, and the first resistor cross section has two or more protrusions on a first outer portion, the first outer portion being that portion of the contour of the first resistor cross section that is located on the side opposite of the first resistor cross section that faces the second resistor cross section, the first outer portion extending from the first position to the second position the protrusions in the first resistor cross section are provided near both sides of the first portion in an orthogonal direction that is perpendicular to both the axial direction of the base member and a direction where the first portion and the second portion face each other.

2. A ceramic heater according to claim 1, wherein the second resistor cross section has no protrusion on a second inner portion, the second inner portion being a portion of the contour of the second resistor cross section located on the side toward the first resistor cross section, the second inner portion extending from a third position at which the contour is in contact with the first straight line to a fourth position at which the contour is in contact with the second straight line, and the second resistor cross section has two or more protrusions on a second outer portion, the second outer portion being a portion of the contour of the second resistor cross section located on the side opposite the first resistor cross section, the second outer portion extending from the third position to the fourth position, wherein the protrusions in the second resistor cross section are provided near both sides of the second portion of the orthogonal direction.

3. A ceramic heater according to claim 1 or 2, wherein, in the cross section of the ceramic heater, when the first outer portion is divided into two equi-length portions having the same length, the first resistor cross section has at least one protrusion on each of the equi-length portions.

* * * * *